US010006738B2

(12) United States Patent
Stoppenhagen

(10) Patent No.: US 10,006,738 B2
(45) Date of Patent: Jun. 26, 2018

(54) ARCHERY HAND WARMING DEVICE

(71) Applicant: Randall T. Stoppenhagen, Nampa, ID (US)

(72) Inventor: Randall T. Stoppenhagen, Nampa, ID (US)

( * ) Notice: Subject to any disclaimer, the term of this patent is extended or adjusted under 35 U.S.C. 154(b) by 0 days. days.

(21) Appl. No.: 15/402,072

(22) Filed: Jan. 9, 2017

(65) Prior Publication Data

US 2017/0234643 A1 Aug. 17, 2017

Related U.S. Application Data

(60) Provisional application No. 62/276,742, filed on Jan. 8, 2016.

(51) Int. Cl.
*F41B 5/14* (2006.01)

(52) U.S. Cl.
CPC ..... *F41B 5/1442* (2013.01); *F41B 5/14* (2013.01); *F41B 5/148* (2013.01)

(58) Field of Classification Search
CPC ..... A63B 71/141; A63B 2244/04; F41B 5/14; F41B 5/1473; F41B 5/148
See application file for complete search history.

(56) References Cited

U.S. PATENT DOCUMENTS 295,586 A 3/1884 Ross
571,020 A 11/1896 Royce
1,202,734 A 10/1916 Kirby
1,970,081 A 8/1934 Eisendrath
2,089,086 A 8/1937 Farkas
2,274,335 A 2/1942 Bert
2,318,785 A 5/1943 Kopplin
2,603,790 A 7/1952 Boehm-Myro
2,630,361 A 9/1953 Grothe et al.
2,997,042 A 8/1961 Mitchell
4,213,205 A 7/1980 Smith
4,383,336 A 5/1983 Beckman et al.
4,698,851 A 10/1987 Dunford et al.
4,727,675 A 3/1988 Huntt
4,742,579 A 5/1988 Dunford
4,754,498 A 7/1988 Stinemates
4,805,338 A 2/1989 Schublom
5,172,427 A 12/1992 Bergen et al.
5,177,893 A 1/1993 Huntt
5,295,268 A 3/1994 Pociask
5,375,263 A 12/1994 Cuccia
5,461,728 A 10/1995 Staszak
5,553,324 A 9/1996 Emerson
(Continued)

*Primary Examiner* — John Ricci
(74) *Attorney, Agent, or Firm* — Scott D. Swanson; Shaver & Swanson, LLP

(57) ABSTRACT

What is disclosed is an archery hand warming device that functions to keep a user's bow hand warm when grasping an archery bow. The device has a sleeve that fits over a user's forearm and two flaps that wrap around a user's hand when grasping the handle of a bow so as to shield a user's bow hand from the elements. The archery hand warming device utilizes a grommet or other opening typically located in one or both flaps which allows for the passage of a male threaded connector of a typical archery stabilizer to pass through and connect to the female threaded connector of an archery bow in order to mount or attach the archery hand warming device to the archery bow.

16 Claims, 6 Drawing Sheets

(56) References Cited

U.S. PATENT DOCUMENTS

| | | | | |
|---|---|---|---|---|
| 5,557,805 | A | 9/1996 | Emerson | |
| 5,617,853 | A | 4/1997 | Yates et al. | |
| 5,678,248 | A | 10/1997 | Lengyel | |
| 5,678,249 | A | 10/1997 | Smith | |
| 5,699,632 | A | 12/1997 | Stout et al. | |
| 5,774,894 | A | 7/1998 | Yates et al. | |
| 5,845,337 | A | 12/1998 | Smith | |
| D410,957 | S | 6/1999 | Hubsher | |
| 6,052,828 | A | 4/2000 | Widdemer | |
| 6,233,743 | B1 | 5/2001 | Cummins | |
| 6,393,615 | B1 | 5/2002 | Bedell | |
| 6,449,772 | B1 | 9/2002 | Donner | |
| D489,149 | S | 4/2004 | Horner | |
| 6,898,804 | B2 | 1/2005 | Sandler | |
| 7,290,291 | B2 | 11/2007 | Anderson et al. | |
| 7,490,363 | B2 | 2/2009 | Hildebrandt et al. | |
| 2006/0191184 | A1* | 8/2006 | Wisecup ..... | F41A 35/02<br>42/96 |
| 2006/0248624 | A1 | 11/2006 | Pieczynski | |

* cited by examiner

ARCHERY HAND WARMING DEVICE

PRIORITY/CROSS-REFERENCE TO RELATED APPLICATIONS

This application claims the benefit of U.S. Provisional Application No. 62/276,742 filed Jan. 8, 2016 the disclosure of which is incorporated by reference.

TECHNICAL FIELD

Presently disclosed technology relates to the field of archery equipment, and more particularly to an archery clothing that keeps an archer's bow hand warm while the archer is grasping a compound archery bow.

BACKGROUND

Compound archery bows have become very popular for hunting and target shooting. Typically these bows utilize a bow string stretched between two limbs. An archer grasps a handle that is located on the frame of the bow between the two limbs. The archer typically utilizes the archer's non-dominant hand (called the bow hand hereinafter) to grasp the bow handle. The archer then draws the bowstring back to load energy into the limbs of the bow by pulling the limbs closer together by drawing back the bowstring stretched between the bow limbs. When the archer releases the bowstring, the energy stored in the limbs of the bow is released as the limbs spring apart and the bowstring and arrow nocked on the bowstring is propelled forward.

When an archer is carrying the bow or holding the bow, an archer may grasp the bow handle with the archer's bow hand. When the archer goes to shoot the bow, the archer places the archer's bow hand on the grip to provide an opposite force to when the archer draws the bow string back. This allows the archer to draw the bow string back and subsequently release the bow string, thus releasing the energy stored in the limbs of the bow to propel an arrow forward.

Often times bow hunting seasons occur during cold periods of the year. Similarly, archers may want to shoot a bow during cold periods of the year. An archer can use a standard glove to keep the archer's hand warm. However, this can be inadequate to provide sufficient insulation and thus warmth to an archer's hand if the archer is holding the bow for the duration of the day. For example, an archer during a late whitetail deer hunt, which often occurs in northern states during November and December, may stand in a tree stand with the bow at the ready for an hour or longer. During the day, the archer's hand may get cold from grasping the bow handle. The archer can remove his or her hand from the bow handle to warm it up, but this puts an archer at a position in which if a deer appears, the archer will not be ready to shoot the bow.

Accordingly, what is needed is a device that will keep an archer's hand warm while grasping the bow, allow the archer to shoot the bow without interfering with the mechanical aspects of the bow, and provides an easy to use interface such that a user can easily remove and re-insert the user's hand into the device without have to remove the device from the bow.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is an archery hand warming device that has a sleeve with a first opening through which a user extends his or her hand to position the sleeve around a user's forearm. The sleeve has an opening at the opposite end of the sleeve through which the user can grasp a bow handle. The sleeve has two flexible flaps, preferably fabric but alternative material can be used including, but not limited to, neoprene, extend away from the end of the sleeve and on generally opposing sides of the end of the sleeve. The flaps are configured to envelop or partially wrap around the handle of a bow in opposing directions such that one flap overlays or overlaps the other flap.

The archery hand warming device has an opening in at least one of the flaps configured for the through passage of a male end of an archery stabilizer. In a preferred embodiment the opening is a grommet. The male end of the stabilizer can then be attached to the female stabilizer attachment standard on compound archery bows. The stabilizer then functions to attach or hold the archery hand warming device to the bow.

In a preferred embodiment the archery hand warming device has a mechanism to hold the overlapping flap in place around the bow. This can be two sections of a strap that are releasably connected by a buckle. In a preferred embodiment one of the ends of the strap is connected to the sleeve with the second ends of the strap connected to the flap. Preferably the buckle includes the ability to tighten the tension on one or the other sections of strap.

In a preferred embodiment the archery hand warming device has a generally flexible cylindrical section configured to circumvolve a user's forearm generally as a sleeve. The cylindrical section has a first end and a second end and defines a circumference at the first end and the second end. The first end has an opening configured for the insertion of a user's hand and forearm and the second end has an opening that is defined by a circumference from which two flaps extend. The two flaps extend generally from opposing locations of the circumference of the second opening. In a preferred embodiment the two flaps are constructed of a flexible material such that the two flaps can bend or fold toward one another so as to overlap around the handle of a bow. The flaps are configured such that the flaps overlap the handle of a bow when a user is utilizing the archery hand warming device. The user is then able to grasp the handle of the bow such that the cylindrical section is circumvolving a user's forearm and the overlapping flaps are protecting the user's hand from the elements such as rain, snow, wind, and/or cold.

The flaps include an opening on at least one of said flaps configured for the through passage of a male connector of an archery bow stabilizer, although this opening could be located on an additional flap or similar location. The opening, in a preferred embodiment a grommet, is configured such that when an archery bow stabilizer passes through said opening and is attached to a bow said archery hand warming device is attached to the bow.

The archery hand warming device includes in a preferred embodiment at least one retaining mechanism that is configured to retain the second flap in position when wrapped around the bow handle and over the first flap. The archery hand warming device can include a pocket located on the interior of the first flap into which a user can place his or her fingers when using device to keep the user's fingers warm. Alternatively the user can place a hand warmer in this pocket to warm the user's hands.

In a preferred embodiment the tensioning mechanism of the device includes at least one tensioning mechanism. Preferably this tensioning mechanism is located in a plane defined by a lengthwise axis of the cylinder. The tensioning mechanism is configured to adjust the tension of said second flap in a plane parallel to the plane defined by said lengthwise axis of said cylinder.

In a further embodiment the archery hand warming device tensioning mechanism comprises a second tensioning mechanism configured to adjust the tension of the overlapping flap of the archery hand warming device in a plane generally at a 45 degree angle to the plane defined by said lengthwise axis. While these tensioning devices are exemplary, any tensioning and/or attachment device can be utilized to maintain the overlapping flap in position. This can include, but is not limited to, one or more buckles, hook and loop connectors, zippers, and/or snaps.

In a preferred embodiment the archery hand warming device includes a tensioning mechanism configured to adjust the circumference of the first end of the cylinder. While this is optional, it is thought to allow a user to adjust the circumference of the opening to provide a tighter or looser fit with the user's clothing.

The archery hand warming device can be constructed with an integrated wrist strap located on the interior of said archery hand warming device. The wrist strap can be made of one or more lengths of cord, such as parachute cord, configured to receive a user's hand through said length of cord. The integrated wrist strap can include a tensioning mechanism to adjust the tension of the wrist strap. The term wrist strap is a common term used in archery terminology.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature

DESCRIPTION OF PREFERRED EMBODIMENTS

Figure 1:
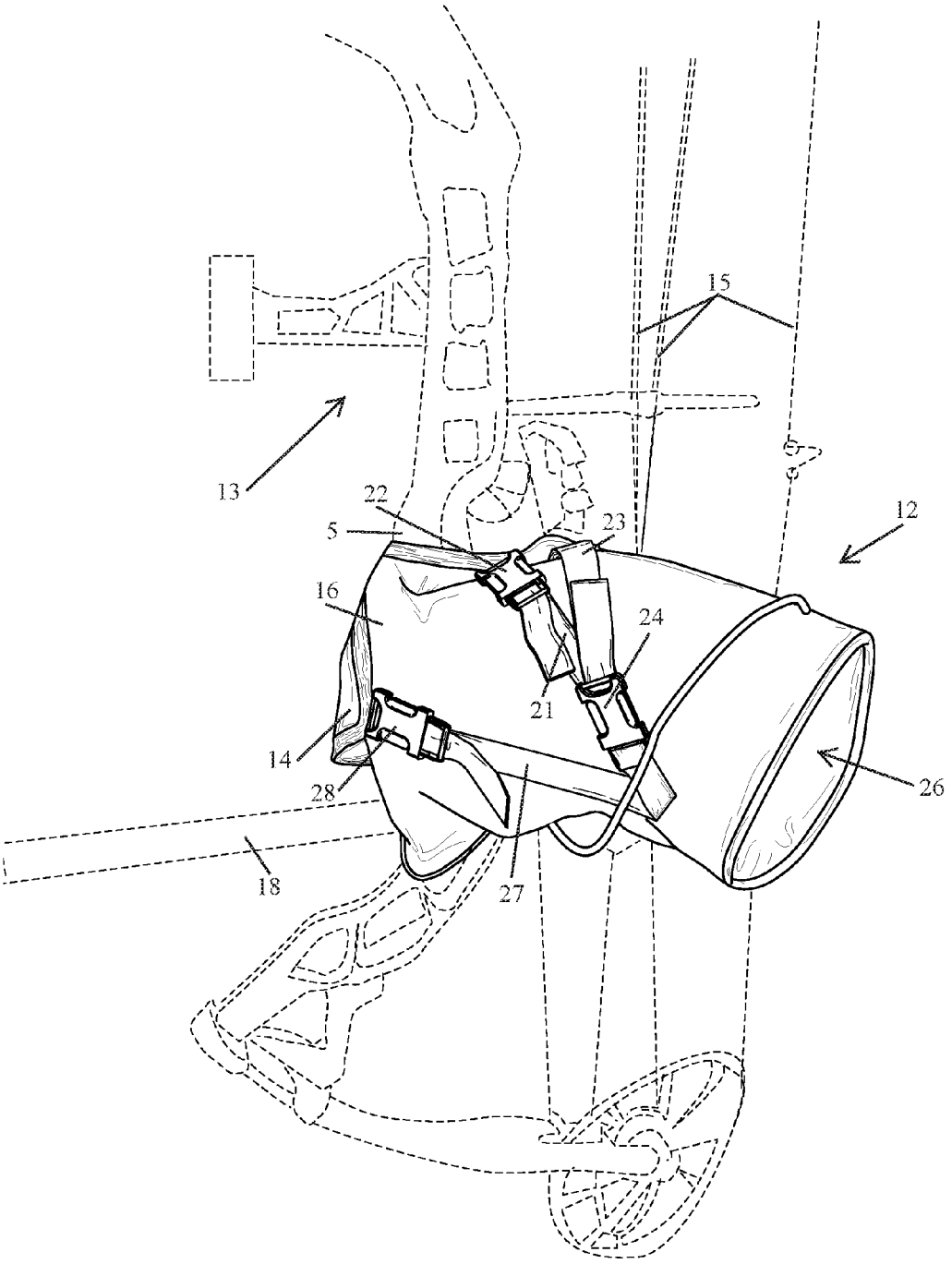
FIG. 1 is a side perspective view of an embodiment of an archery hand warming device attached to a compound bow.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

The figures illustrate an example of a typical compound archery bow 13 with an embodiment of the archery hand warming device 12 positioned on the bow. The bow has upper and lower limbs (upper not shown, lower limb 15) that are utilized, in conjunction with strings 15, to store and release energy generated by an archer to propel or shoot an arrow from the bow. A typical compound bow utilizes a stabilizer 18 that attaches via a threaded male connector 5 component of the stabilizer to a threaded female stabilizer hole 7 on a bow. When using a bow bow, an archer grasps the handle 8 of the bow in shooting the bow and often in carrying the bow.

Figure 2:
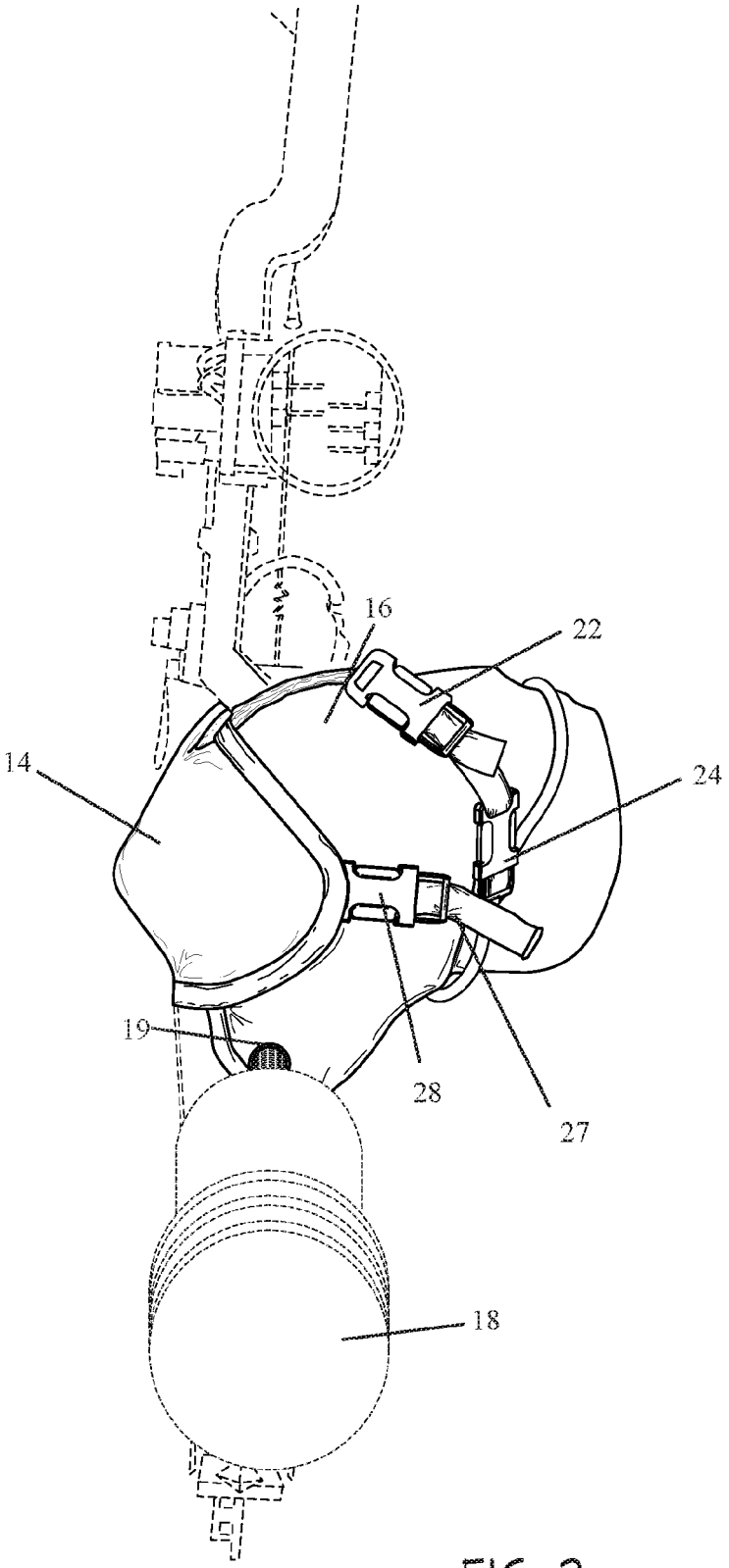
FIG. 2 is a front view of an embodiment of an archery hand warming device attached to a compound bow.
Figure 3:
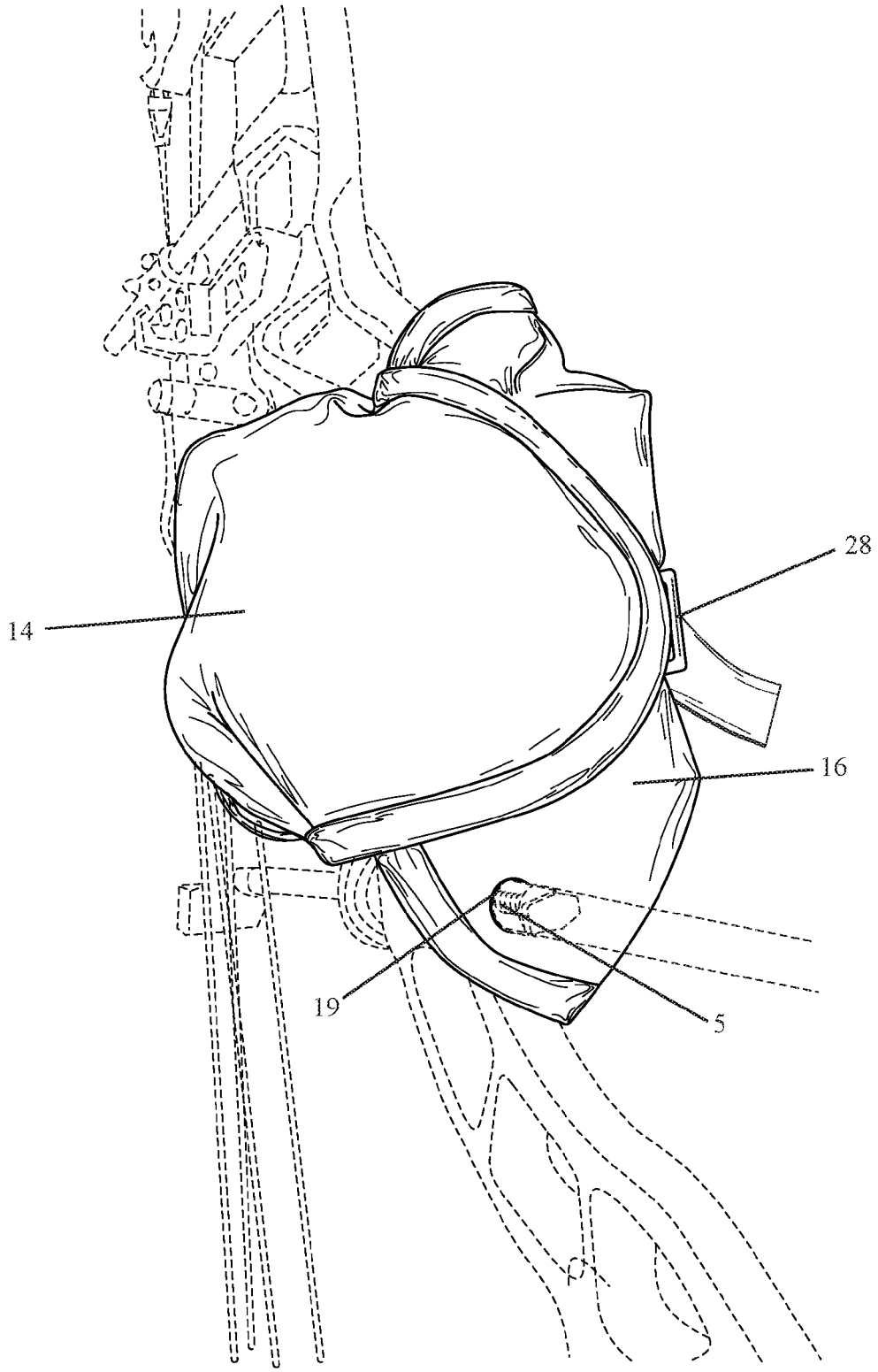
FIG. 3 is a front perspective view of an embodiment of an archery hand warming device attached to a compound bow.

FIG. 2 illustrates an embodiment of an archery hand warming device 12 being used in conjunction with a bow 13. The archery hand warming device is positioned such that two flaps 16, 14 surround the bow grip (not shown). Straps 21, 23, 27 are utilized to hold the flaps of the archery hand warming device in place around the grip. These straps can be adjustable in a preferred embodiment. These straps can be releasably attachable in a preferred embodiment via buckles 22, 24, 28 or via similar attachment mechanisms such as a hook and loop structure. To use the archery hand warming device, an archer inserts the archer's hand into the opening 26 of the archery hand warming device. In a preferred embodiment, within the archery hand warming device and accessible through the opening 26 is a wrist strap.

The archery hand warming device 12 is positioned on the bow handle such that the string(s) 15 of the bow are not in contact with the glove in a preferred embodiment. The archery hand warming device is constructed with a grommet 19 or similar opening positioned such that the stabilizer 18 of the bow protrudes through the grommet 19 where it is attached to the bow. This allows the stabilizer connection to the bow to provide for a connection between the archery hand warming device and the bow. The archery hand warming device has an optional wrist strap that can be used to substitute for a traditional wrist strap on a bow. In a preferred embodiment, the wrist strap (depicted in FIG. 7) protrudes out of the archery hand warming device such that a portion of the wrist strap 28 can be pulled on to tighten the wrist strap.

Figure 4:
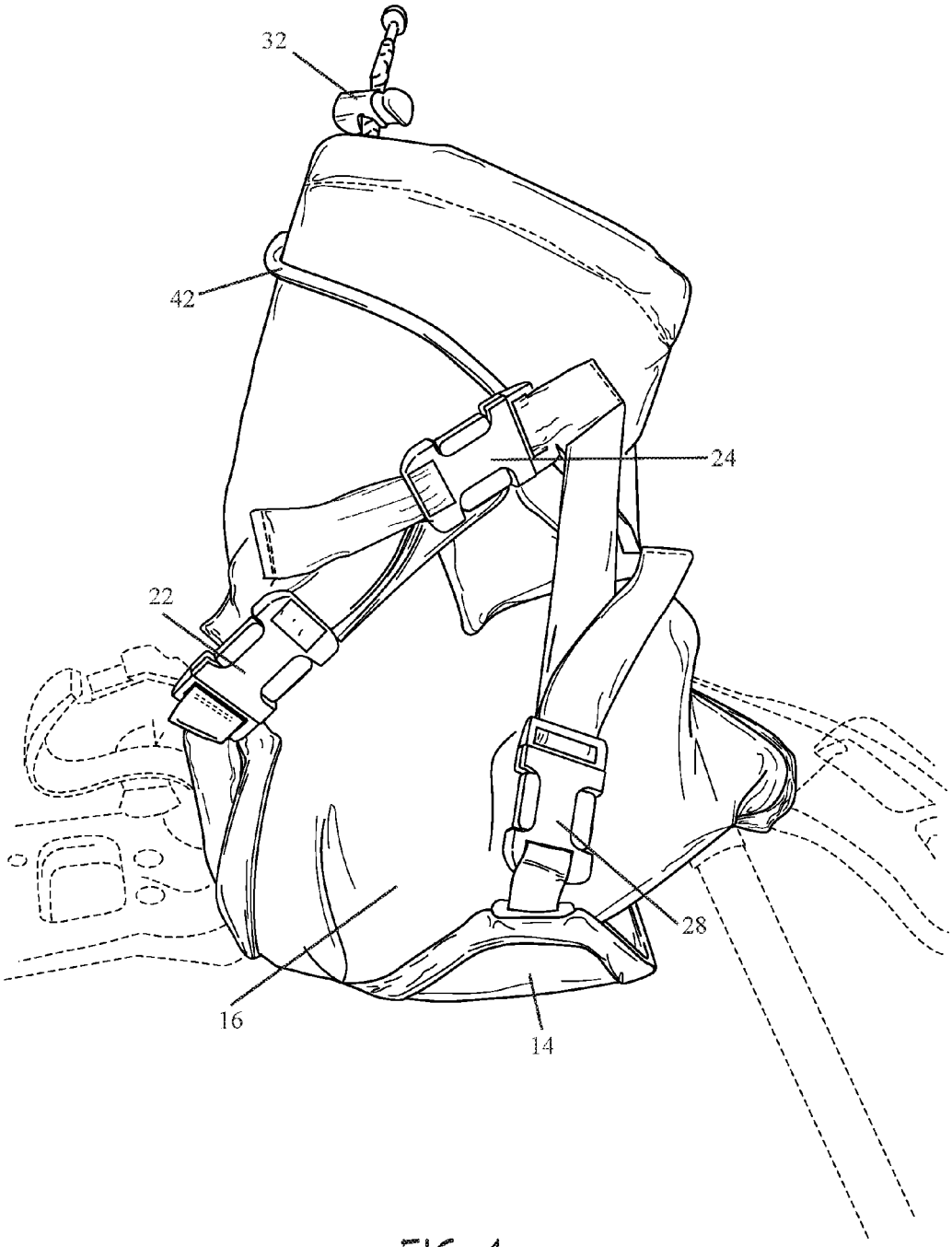
FIG. 4 is a side view of an embodiment of an archery hand warming device attached to a compound bow.

FIG. 4 depicts the archery hand warming device being positioned around the handle 5 of a bow. The two flaps of the archery hand warming device 14, 16 wrap around the handle 5 of the bow. In an embodiment, flap 16 has a pocket 30 for archer's fingers and/or a heat pack or similar object, although this is considered an optional feature. FIG. 4 illustrates in more detail the location of the grommet 19 in relation to the stabilizer 18. Archery hand warming device 14 can similarly be made with an electric heating element. Typically this heating element will be battery powered, with functionality for a user to turn the heating element on or off.

Figure 5:
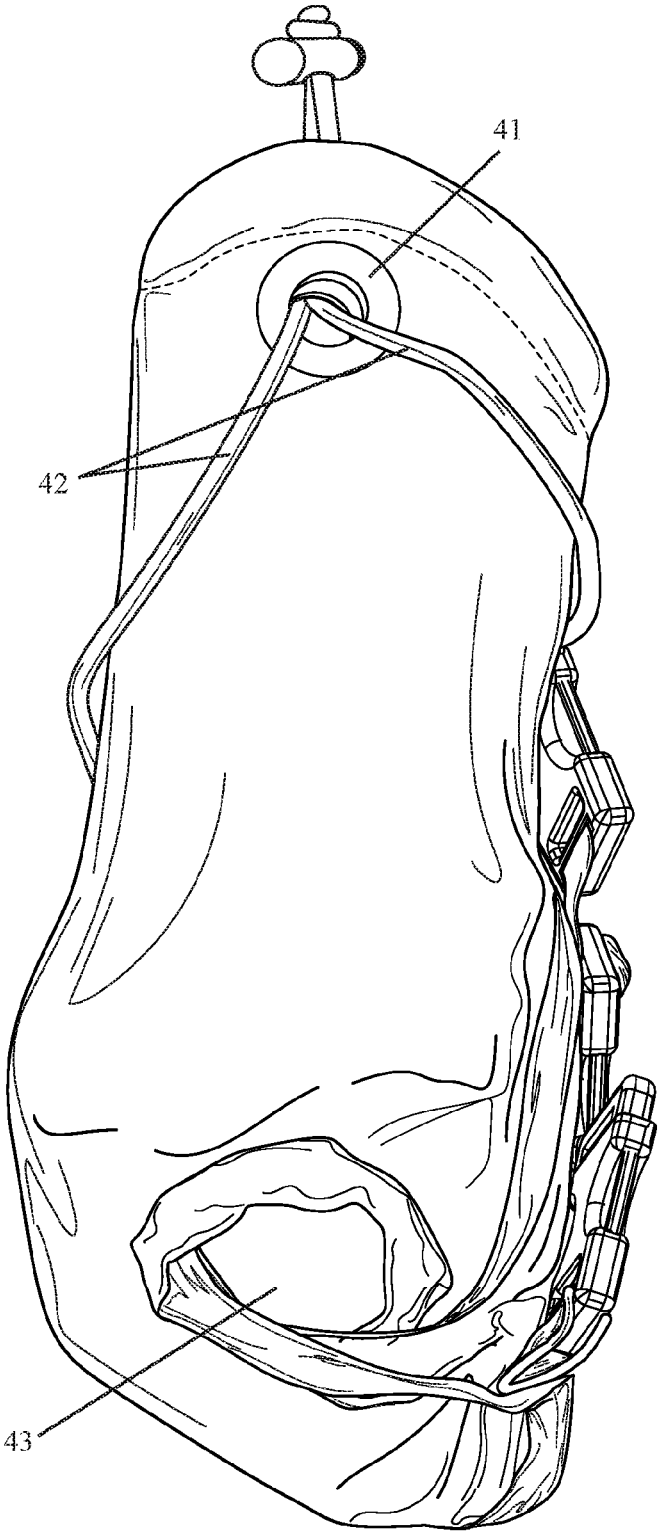
FIG. 5 is a top view of an embodiment of an archery hand warming device.

FIG. 5 illustrates a front view of an embodiment of the invention in which the first flap 16 is wrapped around the bow handle and attached to the bow at the connection point of the stabilizer 18 to the bow. Female portion 22 of the buckle is illustrated as being unattached to the male portion of the buckle 21.

Figure 6:
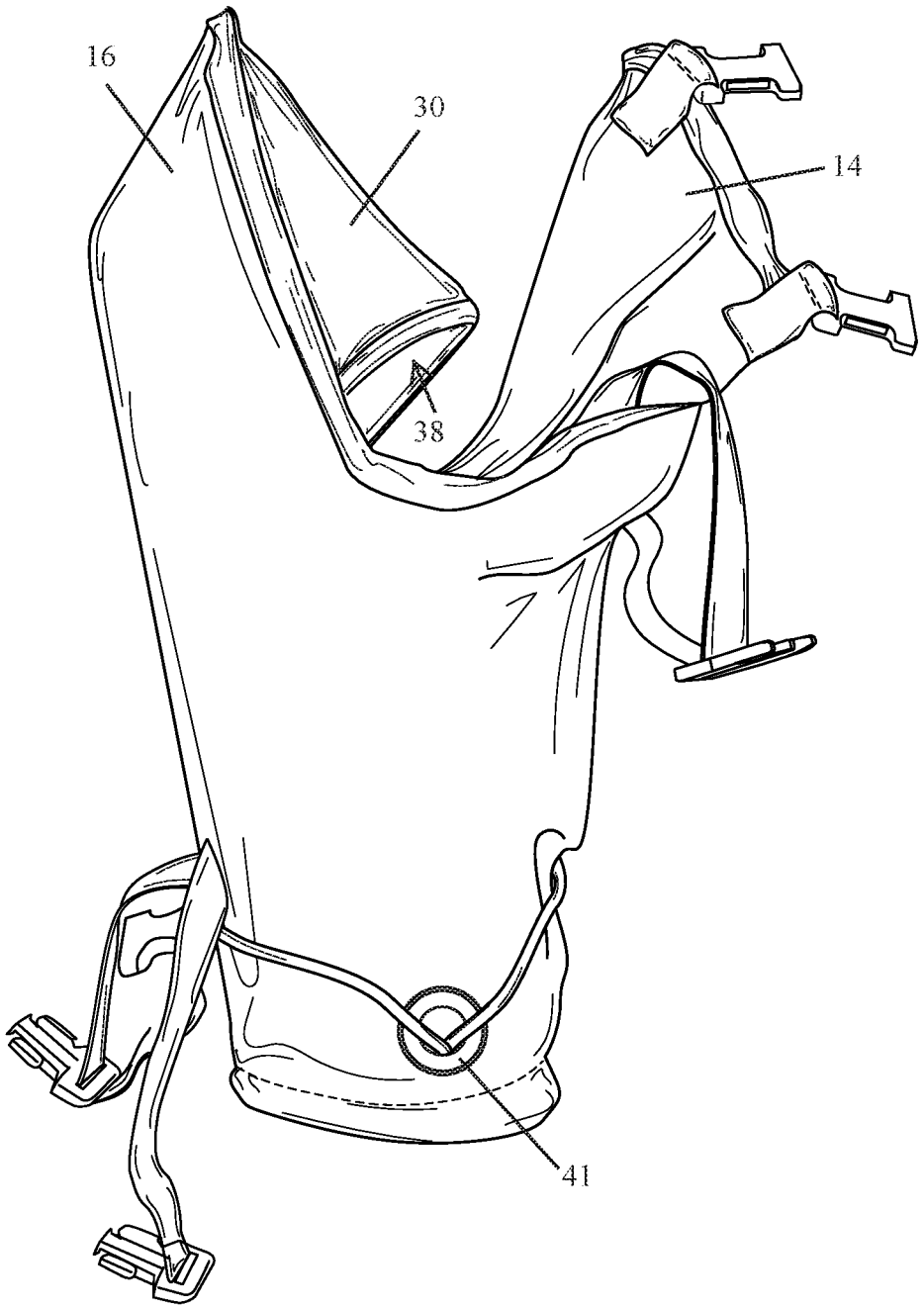
FIG. 6 is a top view of an embodiment of an archery hand warming device illustrating two unwrapped flaps of the device and having buckles of the device in an unbuckled state.

FIG. 6 illustrates a front view of the archery hand warming device attached to a bow. In FIG. 6 the flap 14 is folded over flap 16 and held into place by buckle 28. The tightness of the overlapping between flap 14 and 16 can be controlled via tightening strap 27 in association with buckle 28. Similarly, buckles 22, 24 can be utilized in association with corresponding straps to tighten different vectors of the archery hand warming device.

FIG. 7 illustrates a front left perspective of the archery hand warming device in which flap 14 is folded over flap 16. It is notable that the archery hand warming device of the depicted embodiments is positioned for a right handed bow shooter in which the archery hand warming device is utilized on a shooter's left hand. The depicted embodiment is likely to be reversed for a left handed shooter or alternatively an embodiment could be made in which a pocket is utilized on both internal sides of flaps 14, 16 in order to make the archery hand warming device compatible for left handed or right handed shooters. FIG. 7 depicts a further perspective view in order to illustrate the attachment of the archery hand warming device held in place via grommet 19 held in place by stabilizer 18.

FIG. 8 illustrates the opening 26 in the archery hand warming device through which the archer inserts the archer's hand. In a preferred embodiment, the archer inserts his or her hand through the opening of the wrist strap 34. Subsequently the archer can tighten the wrist strap via the portion of the wrist strap exterior to the archery hand warming device. The archery hand warming device defines an opening having a circumference 32 into which the archer inserts the archer's hand. In a preferred embodiment, the circumference of the archery hand warming device opening is adjustable via a cord or similar or other adjustment mechanism 30. This allows the archer to adjust the circumference of the first end of the archery hand warming device in accordance with the archer's arm circumference.

In a preferred embodiment the wrist strap cord has a cord lock located on the exterior of the archery hand warming device. The wrist strap cord passes through the fabric of the archery hand warming device on top of the archery hand warming device, preferably at a grommet 41 shown in FIG. 12, through the cavity defined by the archery hand warming device for receiving an archer's hand and forearm, and passes through the fabric at the bottom of the hand warming device, preferably through grommets 40 shown in FIG. 40.

FIG. 9 illustrates an open view of the archery hand warming device looked at from the front of the archery hand warming device. Depicted in the illustration are a pocket 30 for an archer's hand 37 to be inserted into the pocket opening 38. The position of the pocket is located in the flap 16. In a preferred embodiment buckle strap 27 and buckle 28 are used to tighten the archery hand warming device generally along a parallel axis to the axis of the longitudinal section of an archer's arm. Straps at buckles 23, 24, 21, 22 generally used to tighten the archery hand warming device along a diagonal vector from the axis parallel to archer's arm. The plurality of straps allows a multitude of potential adjustments to be made to the archery hand warming device while in use. Alternatively, the archery hand warming device can be configured with a single tensioning device or multiple tensioning devices.

FIGS. 10 through 12 illustrate an embodiment of the invention in which the interior wrist strap has been removed from the interior of the archery hand warming device and is being utilized as a tensioner for the archery hand warming device. In a preferred embodiment, the wrist strap illustrated in FIG. 8 can be untied, positioned on the exterior of the archery hand warming device, and positioned on the outside of the archery hand warming device as depicted in FIGS. 10 through 12. The cord 42 that constituted the wrist strap utilizes the same attachment mechanism 40, which in the depicted embodiment constitutes two grommets, to attach to the bow hand warming device in serving as either an interior wrist strap or as an exterior tensioner.

In a preferred embodiment the archery hand warming device is constructed from a flexible fabric that provides an insulating effect to a user. Preferably the material constitutes a water resistant fabric or a fabric with a waterproof, breathable membrane within the fabric. Insulation, such as Thinsulate™, can be utilized between external layers of fabric to provide insulation. In a preferred embodiment, the tensioners utilize nylon webbing straps attached to the archery hand warming device and connected by a buckle. In a preferred embodiment the buckles constitute standard side release buckles that provide for length adjustment of at least one of the lengths of webbing that are connected by the buckles. In a preferred embodiment the wrist strap cord constitutes parachute cord, although a wide variety of cords or straps can be used. The cord constituting the wrist strap or external tensioner can be pulled on to tighten the wrist strap or tensioner, and held into place by a cord lock.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

I claim:

1. An archery hand warming device, wherein said archery hand warming device comprising: a sleeve, wherein said sleeve is configured to be positioned around a user's forearm and wherein said sleeve has two openings at opposing ends;

two flexible flaps, wherein said flaps extend away from a first end of said sleeve on generally opposing sides of said sleeve, wherein said flaps are configured to envelop a handle of a bow by said flaps partially wrapping around a bow handle in opposing directions such that one flap overlaps the other; and an opening in at least one of said flaps configured for the through passage of a male end of an archery stabilizer such that said archery stabilizer attaches said archery hand warmer to a bow when said male end is located through said opening and attached to a female stabilizer connector of an archery bow.

2. The archery hand warming device of claim 1, wherein said opening comprises a grommet.

3. The archery hand warming device of claim 1, wherein said flexible flaps comprise a flexible fabric material.

4. The archery hand warming device of claim 1, wherein said archery hand warming device comprises a retaining device configured to retain the overlapping flap in an overlapping position.

5. The archery hand warming device of claim 4, wherein said retaining device comprises a tensioning device configured to adjust the tension at which the overlapping flap is held in an overlapping position.

6. The archery hand warming device of claim 4, wherein said retaining device comprises a strap attached to said sleeve and to said overlapping flap, wherein a buckle is releasably positioned on said strap between said sleeve and said overlapping flap.

7. The archery hand warming device of claim 4, wherein said retaining device comprises a buckle, wherein said buckle comprises a male portion and a female portion, wherein said male portion is positioned on said cylinder and wherein said female portion is positioned on said second flap.

8. The archery hand warming device of claim 4, wherein said retaining device comprises a tension adjuster for adjusting the tension of said second flap wrapped around said bow handle.

9. An archery hand warming device, said archery hand warming device comprising:

a generally flexible cylindrical section configured to circumvolve a user's forearm, wherein said cylindrical section comprises a first end and a second end and defining a circumference at said first end and said second end, wherein said first end comprises an opening configured for the insertion of a user's hand and forearm, two flaps comprising a first flap and a second flap, wherein said first flap and said second flap extend from said second end from generally opposing locations on said circumference of said second end, wherein said first flap and said second flap comprise a flexible material, wherein said first flap is configured to wrap around a bow handle in a first direction, wherein said second flap is configured to wrap around a bow handle in a second direction toward said first flap such that said second flap overlaps said first flap;

an opening on at least one of said flaps configured for the through passage of a male connector of an archery bow stabilizer, wherein said opening is configured such that when an archery bow stabilizer passes through said opening and is attached to a bow said archery hand warming device is attached to said bow;

at least one retaining mechanism, wherein said retaining mechanism is configured to retain said second flap in position when wrapped around said bow handle and over said first flap.

10. The archery hand warming device of claim 9, wherein said archery hand warming device comprises a pocket attached on an interior of said first flap, wherein said pocket is configured to receive a user's fingers when said user's forearm and hand are positioned within said archery hand warming device.

11. The archery hand warming device of claim 9, wherein said archery hand warming device comprises a first tensioning mechanism, wherein said cylindrical section defines a plane defined by a lengthwise axis of said cylindrical section, wherein said first tensioning mechanism is configured to adjust the tension of said second flap in a plane parallel to said plane defined by said lengthwise axis of said cylindrical section;

wherein said archery hand warming device tensioning mechanism comprises a second tensioning mechanism configured to adjust the tension of said archery hand warming device in a plane generally at a 45 degree angle to said plane defined by said lengthwise axis.

12. The archery hand warming device of claim 9, wherein said archery hand warming device comprises a tensioning mechanism configured to adjust the circumference of said first end of said cylindrical section.

13. The archery hand warming device of claim 9, wherein said archery hand warming device comprises a wrist strap located on an interior of said archery hand warming device.

14. The archery hand warming device of claim 13, wherein said wrist strap comprises a length of cord configured to receive a user's hand through said length of cord.

15. The archery hand warming device of claim 13, wherein said wrist strap comprises two lengths of cord configured for receiving a user's hand between said two lengths of cord.

16. The archery hand warming device of claim 13, wherein said wrist strap comprises a tensioning mechanism.

* * * * *